US008540454B2

(12) United States Patent
Lee

(10) Patent No.: US 8,540,454 B2
(45) Date of Patent: Sep. 24, 2013

(54) MANHOLE COVER

(76) Inventor: Jae Duk Lee, Seoul (KR)

( * ) Notice: Subject to any disclaimer, the term of this patent is extended or adjusted under 35 U.S.C. 154(b) by 28 days.

(21) Appl. No.: 13/143,085

(22) PCT Filed: Dec. 29, 2009

(86) PCT No.: PCT/KR2009/007854
§ 371 (c)(1),
(2), (4) Date: Jun. 30, 2011

(87) PCT Pub. No.: WO2010/077049
PCT Pub. Date: Jul. 8, 2010

(65) Prior Publication Data

US 2011/0268501 A1 Nov. 3, 2011

(30) Foreign Application Priority Data

Dec. 31, 2008 (KR) ..... 10-2008-0137930
Jan. 21, 2009 (KR) ..... 10-2009-0005013

(51) Int. Cl.
*E02D 29/12* (2006.01)

(52) U.S. Cl.
USPC ..... 404/26

(58) Field of Classification Search
USPC ..... 404/25, 26; 52/19, 20
See application file for complete search history.

(56) References Cited

U.S. PATENT DOCUMENTS

| | | | | | |
|---|---|---|---|---|---|
| 1,408,982 | A * | 3/1922 | Calhoun | 404/26 |
| 3,629,981 | A * | 12/1971 | McCaffery | 52/19 |
| 5,360,131 | A * | 11/1994 | Phillipps et al. | 220/8 |
| 5,785,409 | A * | 7/1998 | Reinert, Sr. | 362/153.1 |
| 6,161,984 | A * | 12/2000 | Sinclair | 404/25 |
| 6,464,425 | B1 * | 10/2002 | Closkey | 404/26 |
| 6,524,026 | B2 * | 2/2003 | Sondrup | 404/26 |
| 7,748,927 | B2 * | 7/2010 | Neathery | 404/25 |
| 2003/0235467 | A1 | 12/2003 | Gamson | |

FOREIGN PATENT DOCUMENTS

| | | |
|---|---|---|
| KR | 10-0463579 | 12/2004 |
| KR | 10-0522941 | 10/2005 |
| KR | 10-0634186 | 10/2006 |
| KR | 10-2008-0094375 | 10/2008 |
| KR | 100886876 | 3/2009 |

OTHER PUBLICATIONS

International Search Report for PCT/KR2009/007854 mailed Aug. 13, 2010.

* cited by examiner

*Primary Examiner* — Gary Hartmann
(74) *Attorney, Agent, or Firm* — Christopher Paul Mitchell

(57) ABSTRACT

A manhole cover which has an upper body and a lower body coupled to each other to maintain balance, to endure loads applied from an external source in a stable manner, to protect the inside of the manhole from the ingress of rainwater, and to enable the upper body to be stably fixed inside the lower body.

17 Claims, 8 Drawing Sheets

MANHOLE COVER

RELATED APPLICATIONS

This application is a 371 application of International Application No. PCT/KR2009/007854, filed Dec. 29, 2009, which in turn claims priority from Korean Patent Application Nos. 10-2009-0005013, filed Jan. 21, 2009, and 10-2008-0137930, filed Dec. 31, 2008 each of which is incorporated herein by reference in its entirety.

TECHNICAL FIELD

The present invention relates to a manhole cover, more specifically, a manhole cover wherein ingress of rainwater and foreign matter is prevented by further comprising a waterproofing means arranged inside the upper body, and the upper and lower bodies are stably fastened to each other by forming two or more spiral ribs with the same pitch, and paly of the upper body is prevented by fastening the upper body to the lower body by bolts inclined downwardly, or inserting catching rods between the upper and lower bodies, and coupling strength is enhanced.

BACKGROUND ART

In general, the manhole is installed for maintenance of facilities for water service/sewerage, electrical communication etc., which are laid under the ground, or draining of rainwater, and mainly consists of circular or rectangular structure.

However, since the existing manhole cover cannot be adjusted in its height, the height between slab of manhole structure and road surface is not constant for each manhole, and thus, in the installation of most manhole covers, in order to make the manhole cover flush with the road surface, a space between lower portion of the manhole cover and the slab of the manhole structure is filled with height-adjusting material such as bricks. Therefore, there is a problem that the height-adjusting material such as bricks is destroyed and sinks downward due to reduction of strength of the bricks etc. resulting from ingress of rainwater etc. and fatigue load such as repeated impact load of the vehicle after completion of construction, and accordingly frequent repairing of the manhole cover on the road is required, which makes management of the manhole difficult.

In order to solve the above-mentioned problems, in the prior art, as shown in Patent Registration No. 10-0522941 of the applicant, spiral rib formed on outer surface of an upper body, on which a lid of the manhole cover is mounted, rides over and supported by spiral rib formed on inner surface of a lower body and is secured with bolts, whereby the upper body is supported by the lower body. Irregularities are formed on each spiral rib; the irregularities formed on the lower side of the rib of the upper body and the irregularities formed on the upper side of the rib of the lower body engage with each other, thereby securing the upper body to the lower body. Furthermore, pitch of the rib is made sufficiently large, hence the upper body can be easily rotated. The upper body can be secured to and supported by the lower body with no slip. However, in the case of forming a single spiral rib only, horizontal angle of the rib may not be made on a plane and a certain degree of taper is generated due to problems occurring in the processes of molding and releasing of castings, and thus there is a problem that a minute play may occur due to the taper in coupling of the upper and lower bodies.

Furthermore, when the bolts are to be fastened to the upper body in order to prevent the play in coupling of the upper and lower bodies, necessary bolt-fastening holes should be formed, however, since the height of the upper body should be adjusted to make it flush with the road surface, the bolt-fastening holes are difficult to form or should be formed in a great number in the process of manufacturing in factory. Therefore, there are problems associated with the manufacturing or operations on site are cumbersome, and there is a problem that since the bolt-fastening holes are scattered rainwater may ingress into the bolt-fastening holes in the case of the manhole requiring the waterproof.

Furthermore, since the upper body is secured to the lower body by means of the spiral rib only, the play occurs between the upper and lower bodies, and since the bolts securing the upper body to the lower body are installed in such a way to be connected to the lower body through the inside of the upper body, user should install the bolts while inclining into the inside of the upper body in order to install the bolts, hence there is a problem that installation of the bolts is very inconvenient.

Furthermore, since only single spiral rib is formed, displacement by rotation is longer in adjustment of the height, hence there is a problem that waste of manpower, equipment and time occurs.

Furthermore, since waterproof of the manhole cover cannot be smoothly achieved, there is a problem that rainwater may ingress into the inside of the manhole through the manhole cover.

DISCLOSURE OF THE INVENTION

Problem to be Solved by the Invention

The object of the present invention for solving the problems as mentioned above is to provide a manhole cover wherein the upper body can be kept balanced when coupled with the lower body and can stably resist external loads, rainwater is prevented from ingressing into the inside of the manhole, the upper body can be stably secured inside the lower body, and consumption of manpower, equipment and time for the height adjustment can be minimized in fastening of the upper and lower bodies.

Means for Solving the Problem

The present invention achieving the above-mentioned object and implementing the task for eliminating the drawbacks of the prior art is characterized in that the manhole cover comprises a lower body, the inside of which is hollow, with a spiral rib formed along the inner surface of the hollow space, and convex-concave portions formed on the upper surface of the spiral rib; an upper body which is coupled with the lower body inside the latter, and the inside of which is hollow, with a spiral rib and convex-concave portions formed along outer surface of the upper body to correspond to the spiral rib and convex-concave portions of the lower body, and a stepped portion formed at the upper surface of the upper body; a lid mounted on the stepped portion of the upper body to prevent the ingress of foreign matter into the inside of the upper body; and a waterproofing means removably arranged inside the upper body to prevent the ingress of rainwater into the inside of the manhole.

Meanwhile, the present invention is characterized in that the manhole cover comprises a lower body, the inside of which is hollow, with a spiral rib formed along the inner surface of the hollow space, and a plurality of thread holes formed extending into the inside of the lower body; an upper body which is coupled with the lower body inside the latter, and the inside of which is hollow, with a spiral rib formed along outer surface of the upper body to correspond to the spiral rib of the lower body, and a plurality of guide projections formed between the spiral ribs in a height direction of the upper body, and a stepped portion formed at the upper surface of the upper body; bolts fitted through the thread holes of the lower body to press the upper body between the guide projections thereof, thereby supporting the upper body and at the same time preventing rotation of the upper body; a lid mounted on the stepped portion of the upper body to prevent the ingress of foreign matter into the inside of the upper body; and a waterproofing means removably arranged inside the upper body to prevent the ingress of rainwater into the inside of the manhole.

Meanwhile, the present invention is characterized in that the manhole cover comprises a lower body, the inside of which is hollow, with a spiral rib formed along the inner surface of the hollow space, and a plurality of catching grooves formed in a direction perpendicular to said spiral rib and at a constant interval; an upper body with a spiral rib formed along outer surface of the upper body to correspond to the spiral rib of the lower body such that the upper body can be coupled with the lower body inside the latter, and a plurality of catching grooves formed in a direction perpendicular to said spiral rib of the upper body and at a constant interval, and a stepped portion formed at the upper portion of the upper body; a plurality of catching rods which are installed between the upper body and lower body through the stepped portion and fitted in the catching grooves formed in the spiral ribs of the upper and lower bodies, thereby preventing the upper body from rotating inside the lower body; a lid mounted on the stepped portion of the upper body to prevent foreign matter from ingressing into the inside of the upper body; and a waterproofing means removably arranged inside the upper body to prevent the ingress of rainwater into the inside of the manhole.

Herein, the present invention is characterized in that said waterproofing means comprises a waterproofing plate which is seated on a catching projection formed on the inner surface of the upper body to prevent ingress of rainwater; a first packing member attached to edge of said waterproofing plate so as to wrap the edge, upper portion of the member being extended to upper end of the waterproofing plate and lower portion being in close contact with the catching projection so as to wrap the edge of the waterproofing plate; and a pressing ring arranged over said waterproofing plate and pressing the first packing member extended to the upper end of the waterproofing plate into close contact with the inner surface of the upper body, thereby achieving a tight waterproof.

Furthermore, the present invention is characterized in that said pressing ring is constructed in a turnbuckle type such that the diameter of the ring may be varied.

Furthermore, the present invention is characterized in that for said spiral ribs of the upper and lower bodies, two or more spiral ribs with the same pitch are formed at a constant interval such that coupling strength of the upper and lower bodies may be enhanced.

Furthermore, the present invention is characterized in that thread holes for fitting bolts are formed in the lower body, and the bolts are fastened through said thread holes to secure the upper body, thereby preventing lateral shaking of the upper body.

Furthermore, the present invention is characterized in that said thread holes are formed inclined downwardly toward the upper body, and said bolts are coupled through the inclined thread holes to push the upper surface of the spiral rib of the upper body in a downwardly inclined direction such that the upper body may be more stably supported.

Furthermore, the present invention is characterized in that the manhole cover further comprises a first groove which is formed along edge of lower surface of said lid; a second groove which is formed on upper part of said stepped portion to correspond to said first groove and becomes narrower from bottom to top in its cross section; and a second packing member which is fitted and secured in said second groove and upper end portion of which is fitted in said first groove when the lid is mounted, thereby preventing foreign matter and rainwater from ingressing into the inside of the upper body.

Furthermore, the present invention is characterized in that said catching rods comprise a vertical rod part inserted through the stepped portion to be fitted in the catching grooves of said upper and lower bodies; and a horizontal rod part formed so as to be horizontally bent at an end portion of said vertical rod part and seated on the stepped portion.

Furthermore, the present invention is characterized in that formed in said stepped portion are rod-inserting holes for inserting said vertical rod part, and rod-seating grooves which are connected to said rod-inserting holes and in which said horizontal rod part is inserted.

Effects of the Present Invention

According to the present invention as described above, by arranging the waterproofing means inside the upper body, dirty water, rainwater or other foreign matter is prevented from ingressing into the inside of the manhole, and by forming two or more spiral ribs fastening the upper and lower bodies to each other, fastening strength is enhanced, thus stability against external force is ensured and the balance of the upper body is maintained, and through the catching rods installed between the upper and lower bodies, the rotation of the upper body and therefore variation of the height of the manhole cover are prevented, and water sealing ability is enhanced by pressing the first packing member into close contact with the inner surface of the upper body by adjusting the diameter of the pressing ring through the turnbuckle of the waterproofing means, and by forming the second groove, which becomes narrower from bottom to top, on the stepped portion of the upper body and arranging the second packing member in the second groove, the water sealing ability is enhanced while the second packing member is stably secured. Therefore, in the light of these points the present invention is very useful.

Figure 1:
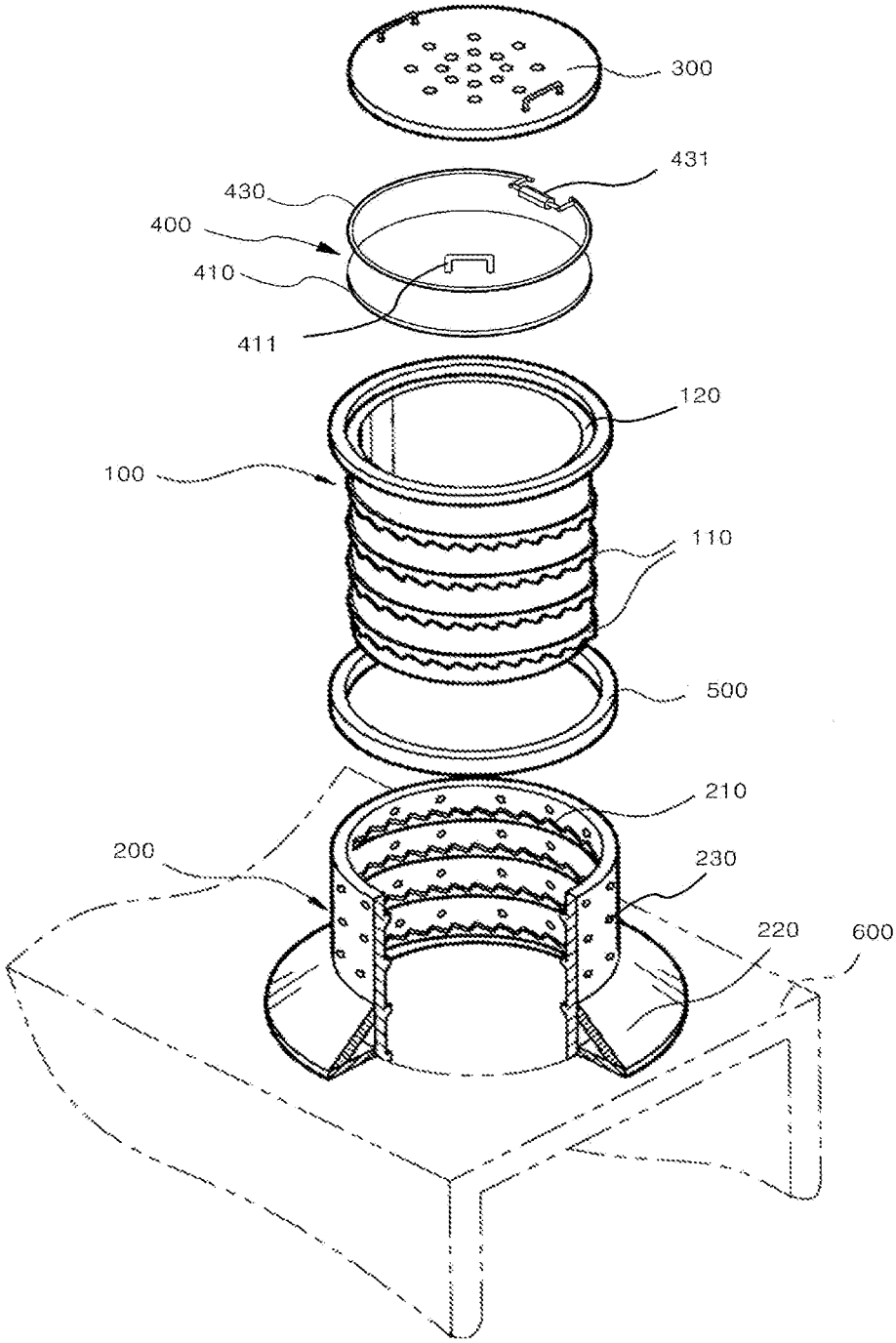
FIG. 1 is a perspective view illustrating a manhole cover of an example of the present invention.

LISTS OF REFERENCE NUMERALS IN THE DRAWINGS (100): upper body
(110): spiral rib
(111): convex-concave portion
(112): catching groove
(120): stepped portion
(121): second groove
(130): catching projection
(140): second packing member
(150): guide projection
(160): rod-inserting hole
(161): rod-seating groove
(170): catching rod
(171): vertical rod part
(172): horizontal rod part
(200): lower body
(210); spiral rib
(211): convex-concave portion
(212): catching groove
(220): housing
(230): thread hole
(240): bolt
(300): lid
(310): first groove
(320): third packing member
(400): waterproofing means
(410): waterproofing plate
(411): handle
(420): first packing member
(421): lower packing
(422): upper packing
(430): pressing ring
(431): turnbuckle
(500): blocking ring
(600): manhole slab

BEST MODES FOR CARRYING OUT THE INVENTION

Modes for Carrying Out the Invention

Hereinbelow, constructions and operations of examples of the present invention will be described in detail with reference to the attached drawings as follows. Furthermore, concrete description of related known functions or constructions will be omitted in the description of the present invention if it is believed to unnecessarily obscure the gist of the present invention.

Figure 2:
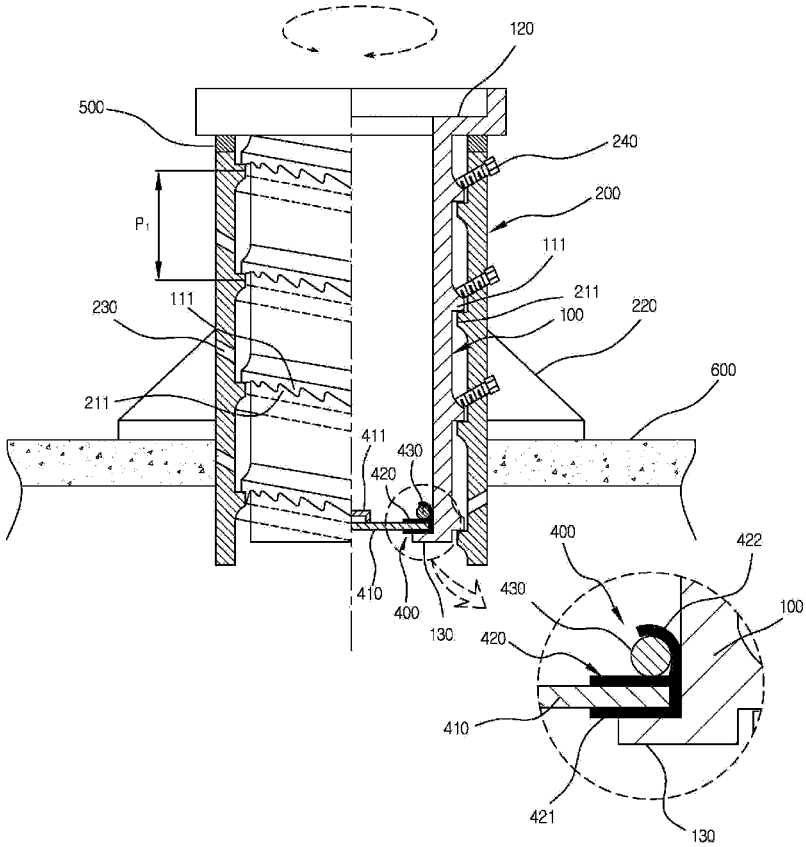
FIG. 2 is a sectional view schematically illustrating a section of the manhole cover of the example of the present invention.
Figure 3:
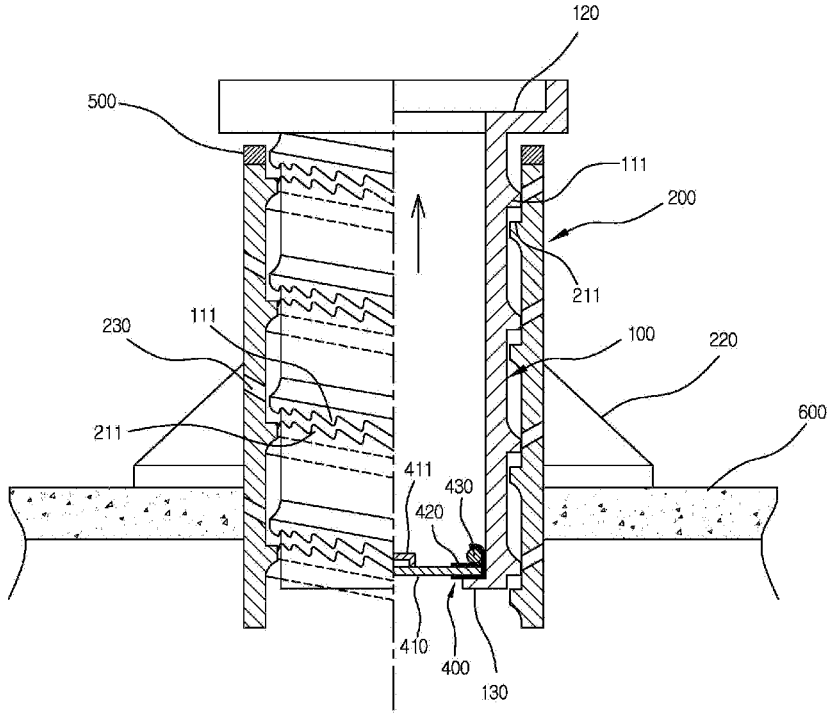
FIG. 3 is a sectional view illustrating a state of operation for adjusting the height of the manhole cover of the example of the present invention.

FIG. 1 is a perspective view illustrating a manhole cover of the present invention, FIG. 2 is a sectional view schematically illustrating a section of the manhole cover of the present invention, and FIG. 3 is a sectional view illustrating a state of operation for adjusting the height of the manhole cover of the present invention. The manhole cover of the present invention comprises a lower body (200), the inside of which is hollow, with a spiral rib (210) formed on the inner surface of the hollow space; an upper body (100) of tubular shape which is coupled inside the lower body (200), with a spiral rib formed on outer surface of the upper body to correspond to the spiral rib (210) of the lower body (200); a lid (300) mounted on upper portion of the upper body (100) to prevent foreign matter from ingressing into the inside of the manhole through the inside of the upper body (100); and a waterproofing means (400) removably arranged inside the upper body (100) to prevent the ingress of rainwater into the inside of the manhole.

Said lower body (200) is installed on a structure of a manhole slab (600) formed of concrete etc., and is supported by a housing (220) which is coupled with an outer surface of said lower body (200) and mounted on the top of the manhole slab (600).

Said upper body (100) is in the shape of a tubular body with its upper and lower ends opened so as to allow a check into the inside of the manhole, and has a stepped portion formed in the upper portion thereof so as to mount said lid (300), and a catching projection (130) formed in the lower portion thereof so as to install said waterproofing means (400).

Meanwhile, pitch (P1) of the spiral ribs (110)(210) of the upper body (100) and the lower body (200) is made larger than a sum of the thicknesses of the spiral ribs (110)(210) of the upper body (100) and the lower body (200) such that said upper body (100) may be rotatably displaced while the spiral rib (110) formed on the upper body (100) and the spiral rib (210) formed on the lower body (200) do not contact with each other.

Meanwhile, formed in the lower body (200) of the present invention are thread holes (230) for coupling the lower body with the upper body (100) by means of bolts (240). The bolts (240) are inserted from the outside of the lower body (200) through said thread holes (230) to press the upper body (100), securing it.

That is to say, the bolts (240) support the upper body (100) while pressing it, whereby the upper body (100) is prevented from playing or laterally moving inside the lower body (200).

Furthermore, since the thread holes (230) are formed in the lower body (200), an operator can do works outside the lower body (200) when installing the bolts (240), and accordingly an inconvenience is eliminated that the operator has to install the bolts (240) while inclining his body into the inside of the upper body (100) as in the prior art, and thus efficiency and speed of operation can be enhanced and disease related with musculoskeletal system of the operator can be prevented.

Meanwhile, said thread holes (230) are formed inclined downwardly toward the upper body (100), and accordingly the bolts (240) are downwardly inclined when inserted in the thread holes (230). The bolts (240) thus inserted push upper surface of the spiral rib (110) of the upper body (100) in downwardly inclined direction, whereby the spiral rib (110) of the upper body (100) and the spiral rib (210) of the lower body (200) more strongly engage with each other, and thus coupling strength is enhanced and accordingly the play is prevented from occurring due to external impact.

Meanwhile, convex-concave portions (111)(211) conforming to each other are formed on lower side of the spiral rib (110) of the upper body (100) and upper side of the spiral rib (210) of the lower body (200), respectively such that the upper body (100) may not be slipped in the lower body (200) even if the pitch (P1) of the spiral ribs (110)(210) of the upper body (100) and the lower body (200) is large, and therefore the upper body may be secured with the convex-concave portions (111) of the upper body (100) and the convex-concave portions (211) of the lower body (200) engaging with each other.

Preferably, the spiral rib (210) formed on the lower body (200) have the convex-concave portions (211) of the same shape repeatedly formed, and the spiral rib (110) formed on the upper body (100) have the convex-concave portions (111) repeatedly formed, which conform to the convex-concave portions (211) on the upper side of the spiral rib (210) of the lower body (200) when oppositely contacting therewith. Therefore, occurrence of a slip is prevented by the convex-concave portions on the contacting surfaces while the spiral rib (110) of the upper body (100) engages with the spiral rib (210) formed on the lower body (200).

Figure 4:
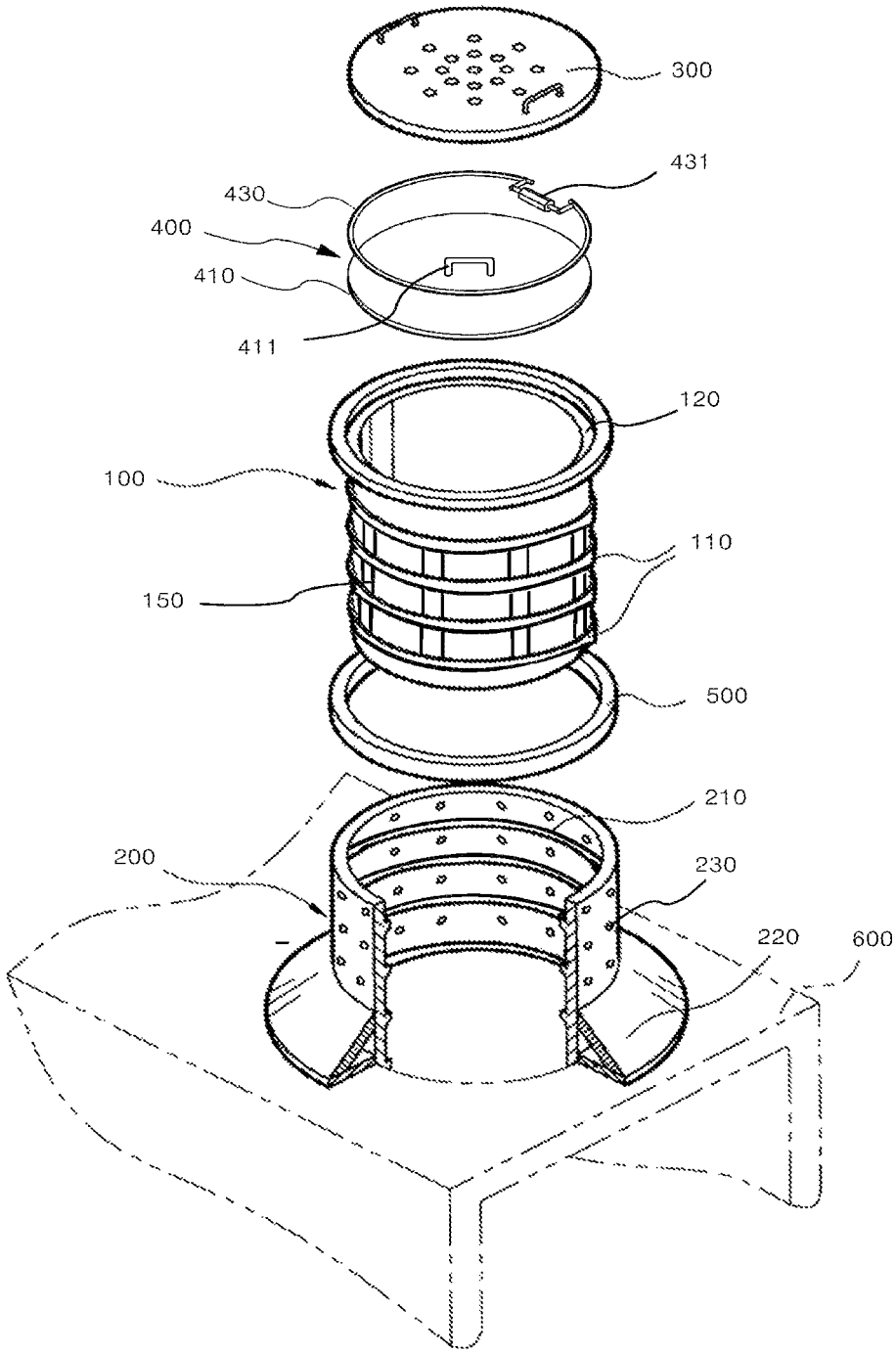
FIG. 4 is a perspective view illustrating a manhole cover of another example of the present invention.
Figure 5:
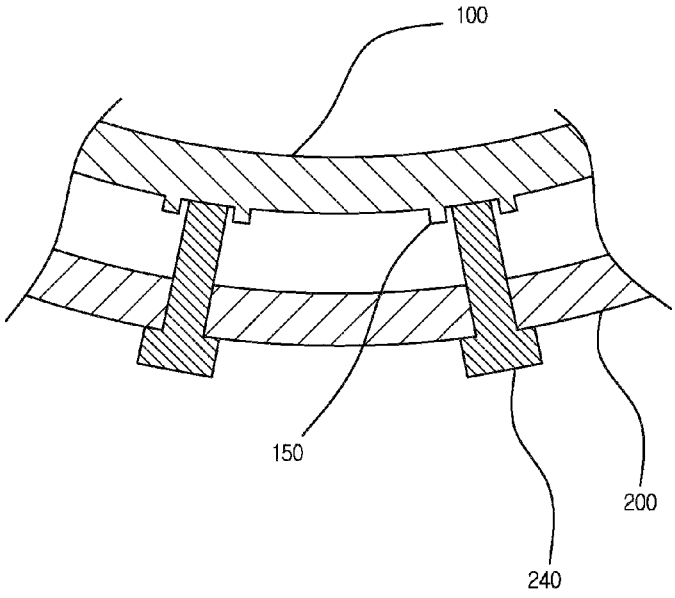
FIG. 5 is a sectional plane view illustrating a state of bolts being installed between guide projections of the present invention.

Meanwhile, in the present invention, as shown in FIGS. 4 and 5, a plurality of guide projections are formed between the spiral ribs of the upper body in a height direction of the upper body, and the upper body can be restrained by inserting and fastening said bolts between the guide projections.

Such guide projection (150) are arranged between the spiral ribs (110) in the height direction of the upper body (100); when the upper body (100) is rotated inside the lower body (200) by the external impact, since the bolts (240) are caught by the guide projections (150), the upper body (100) is prevented from rotating inside the lower body (200), and thus an initial installation height of the manhole may be maintained.

Figure 6:
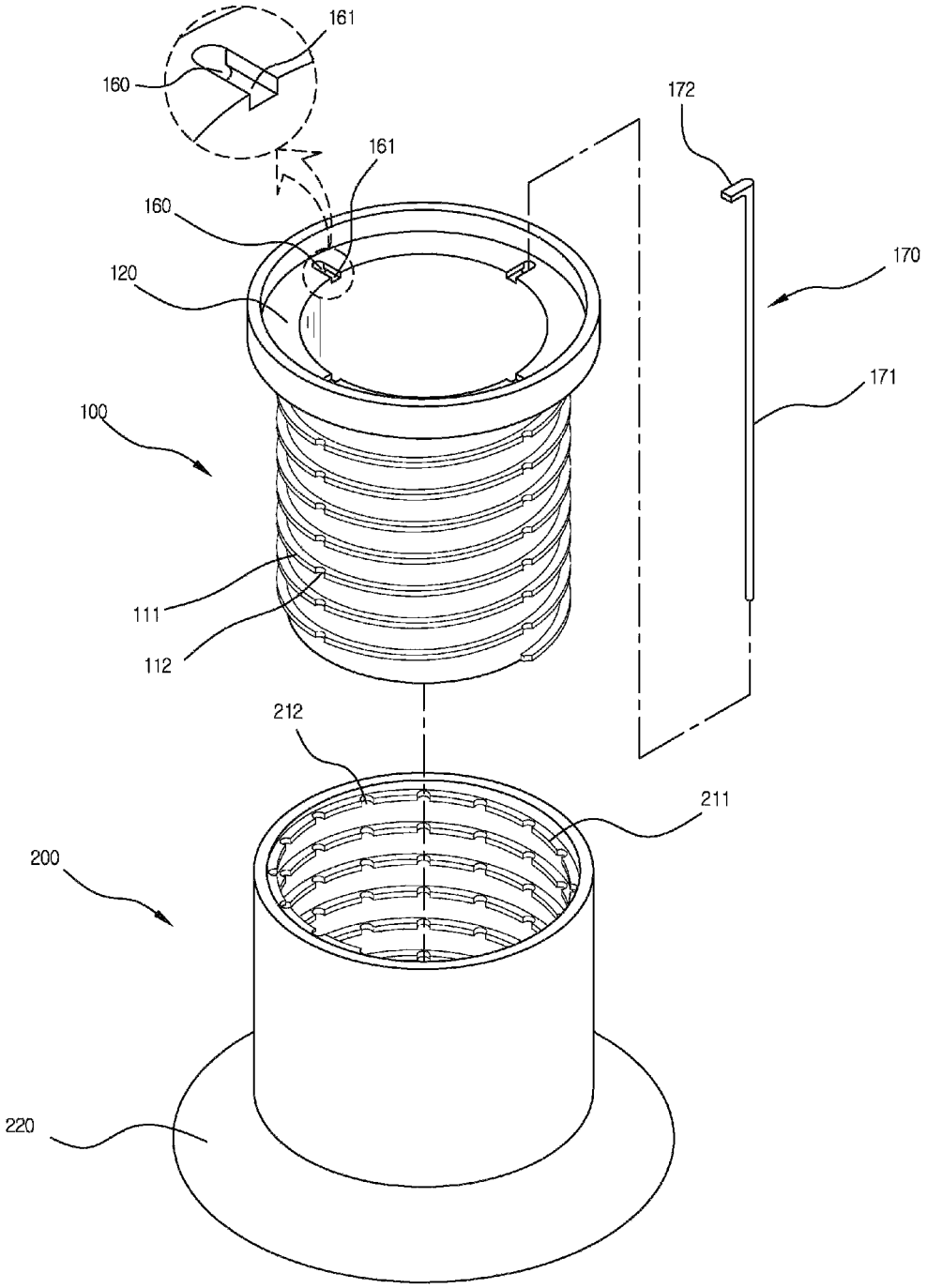
FIG. 6 is an exploded perspective view illustrating the upper and lower bodies of the manhole cover according to yet another example of the present invention.
Figure 7:
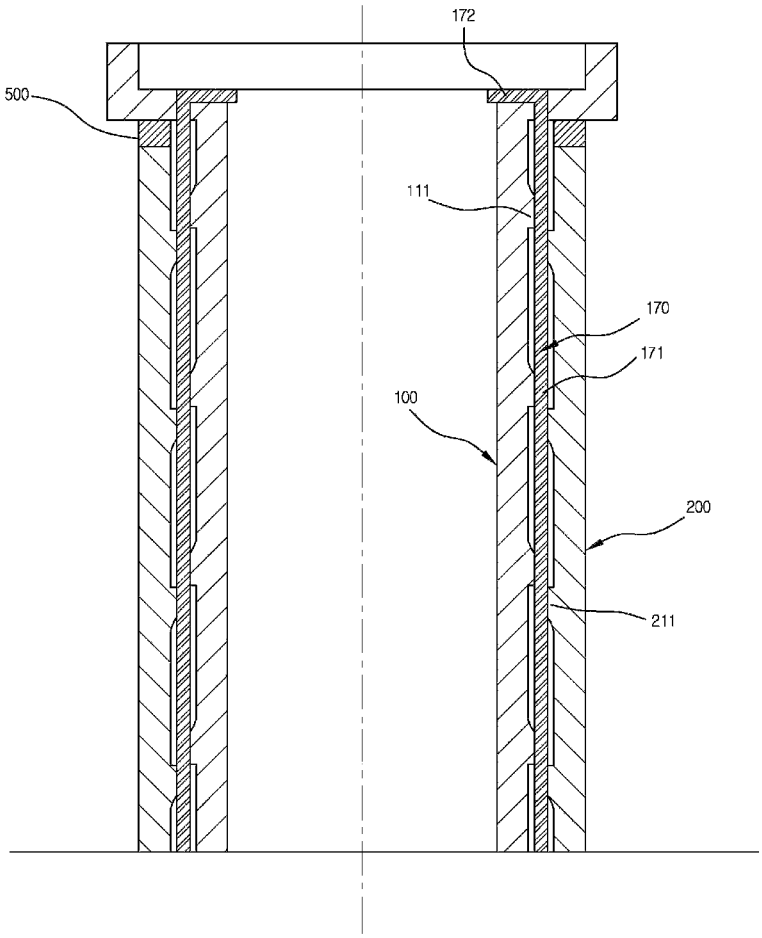
FIG. 7 is a sectional view illustrating a coupling state of the upper and lower bodies of the manhole cover according to the yet another example of the present.

Meanwhile, FIG. 6 is an exploded perspective view illustrating the upper and lower bodies of the manhole cover according to another example of the present invention, and FIG. 7 is a sectional view illustrating a coupling state of the upper and lower bodies of the manhole cover according to the another example of the present invention.

As shown in the figures, the lower body (200) is constructed such that the inside of the lower body is hollow, the spiral ribs (210) are formed along the inner surface of the hollow space, and a plurality of catching grooves (212) are formed in a direction perpendicular to said spiral ribs (210) and at a constant interval.

Furthermore, the upper body (100) has the spiral ribs (110) formed along its inner surface which correspond to said spiral ribs (210) such that the upper body may be coupled with the lower body (200) inside the latter, and a plurality of catching grooves (112) are formed in a direction perpendicular to said spiral ribs (110) and at a constant interval, and the stepped portion (120) is formed in the upper portion of the upper body for mounting the lid (300).

The upper body (100) and lower body (200) constructed as above are secured by a plurality of catching rods (170) which are installed between the upper body (100) and lower body (200) through the stepped portion (120) and fitted in the catching grooves (112)(212), thereby preventing the upper body (100) from rotating inside the lower body (200).

Said catching rods (170) comprise a vertical rod part (171) fitted in the catching grooves (112)(212) of said upper body (100) and lower body (200), and a horizontal rod part (172) horizontally formed on one end of said vertical rod part (171) and seated on the stepped portion (120) such that the catching rods (170) cannot play and escape into the inside of the manhole when the upper body (100) plays.

Furthermore, four or more catching rods (170) are installed in order to stably secure the upper body (100) and lower body (200), as shown in the figure.

Meanwhile, formed in said stepped portion (120) are rod-inserting holes (160) for inserting the vertical rod part (171) of said catching rods (170), and rod-seating grooves (161) connected to said rod-inserting holes (160) and concavely formed such that the said horizontal rod part (172) can be seated.

Said rod-seating grooves (161) are formed in such a way to be opened to the hollow space in the upper body (100) and the horizontal rod part (172) of the catching rod (170) is formed longer than the length of the rod-seating grooves (161), whereby an end of the horizontal rod part (172) partially protrudes into the hollow space, and thus the operator can hold the catching rod (170) and therefore installation and removal of the catching rods (170) are facilitated.

Meanwhile, said rod-inserting holes (161) are positioned on the same vertical line as the catching grooves (112) formed in the spiral ribs (110) of said upper body (100), so that the catching rods (170) can be fitted through the rod-inserting holes (161) into the catching grooves (112).

When the catching rod (170) constructed as above is to be installed, the catching grooves (112)(212) formed in the spiral ribs (110)(210) of said upper body (100) and lower body (200) are positioned on a vertical line, and then the vertical rod part (171) of the catching rod (170) is inserted through the rod-inserting hole (161) into the catching grooves (112)(212), whereby the upper body (100) is secured to the lower body (200) via the catching rod (170).

Furthermore, the horizontal rod part (172) is seated inside the rod-seating groove (161), and thus does not interfere with the lid (300) when the lid is installed on the stepped portion (120).

Meanwhile, the catching grooves (212) formed in the spiral ribs (210) of the lower body (200) are formed at narrower interval than that of the catching grooves (112) formed in the spiral ribs (110) of the upper body (100), so that a minute adjustment of the height of the manhole cover is possible.

Meanwhile, the waterproofing means (400) of the present invention comprises a waterproofing plate (410) which is seated on a catching projection (130) formed on the inner surface of the upper body (100) to prevent ingress of rainwater; a first packing member (420) attached to edge of said waterproofing plate (410) so as to wrap the edge, upper portion of the member being extended to upper surface of the waterproofing plate (410) and lower portion being in close contact with the catching projection (130) so as to wrap the edge of the waterproofing plate (410); and a pressing ring (430) arranged over said waterproofing plate (410) and pressing the first packing member (420) extended to the upper surface of the waterproofing plate (410) into close contact with the inner surface of the upper body (100), thereby achieving a tight waterproof.

Said first packing member (420) comprises a lower packing (421) with a "⊏"-like shape in cross section attached to edges of the upper and lower surfaces of the waterproofing plate (410) while covering the edges; and a upper packing (422) formed over the lower packing (421) and rounded in cross-sectional shape such that the upper packing may wrap a part of said pressing ring (430).

For the first packing member (420) as described above, the lower packing (421) perfectly wraps the edge of the waterproofing plate (410), thereby preventing leakage of water between the waterproofing plate (410) and the inner surface of the upper body (100), and the upper packing (422) wraps the pressing ring (430), and thus is pressed by the pressing ring (430) into close contact with the inner surface of the upper body (100), thereby achieving a tight waterproof.

Figure 8:
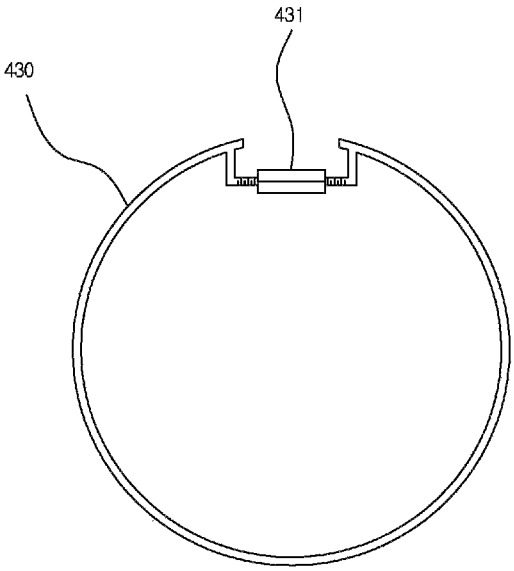
FIG. 8 is a plane view illustrating a pressing ring of the waterproofing means of the present invention.

Meanwhile, as shown in FIG. 8, both ends of the said pressing ring (430) are connected to each other by a turnbuckle (431) such that the diameter of the ring may be varied, so the diameter is varied by tightening and loosening the turnbuckle (431), whereby the upper packing (422) of the first packing member (420) is pressed into close contact with the inner surface of the upper body (100), thereby achieving a tight waterproof.

Meanwhile, said waterproofing plate (410) is further equipped on its one side surface with a handle (411). If the operator will remove the waterproofing plate (410) from the inside of the upper body (100) so as to move into the manhole, he holds the handle (411) to simply remove the waterproofing plate (410), and then can move into the manhole.

Figure 9:
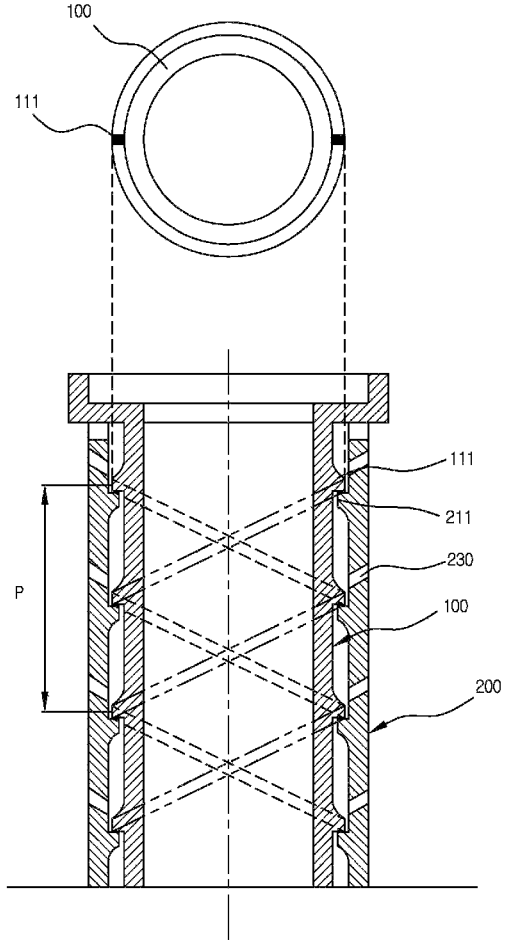
FIG. 9 is a view illustrating an example of double spiral rib of the present invention.

Meanwhile, FIG. 9 illustrates an example of double spiral ribs according to the present invention. For the spiral ribs (110)(210) of the upper body (100) and lower body (200) of the present invention, two spiral ribs with the same pitch (P2) are formed at a constant interval such that the coupling strength between the upper body (100) and lower body (200) can be enhanced.

That is to say, when the upper body (100) and lower body (200) are fastened to each other by the two spiral ribs (110) (210), the upper body (100) is stably supported against external load and fastened while being balanced inside the lower body (200), and thus its play can be prevented.

Figure 10:
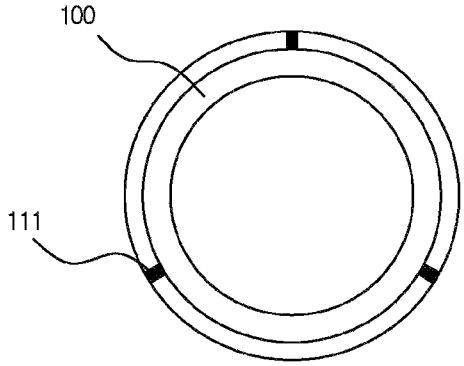
FIG. 10 is a plane view illustrating an example of triple spiral rib of the present invention.

Preferably, the upper body (100) can be more stably supported within the lower body (200) by forming three spiral ribs (110) as shown in FIG. 10.

That is to say, in the case of the three spiral ribs (110) being formed, the upper body (100) is supported and secured inside the lower body (200) at three portions, and thus fastening strength of the upper body is enhanced and it can be kept stable and balanced against the external force.

Furthermore, since the pitch (P) of the spiral ribs (110) (210) is lager, in the case of a large manhole cover for electrical and communication applications etc., displacement of the upper body by rotation thereof becomes larger, whereby the time taken for holding and rotating the heavy upper body (100) is shortened, and therefore simplicity of use can be exhibited when the user adjusts the height of the manhole cover and disease related with his musculoskeletal system can be prevented.

Figure 11:
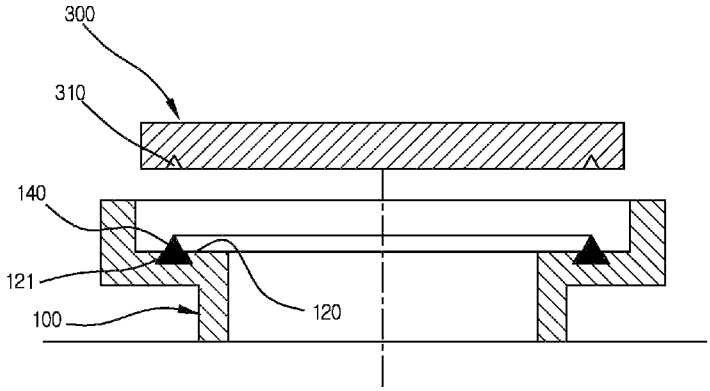
FIG. 11 is a sectional view illustrating a state of a second packing member of the present invention being arranged.

Meanwhile, in the present invention, as shown FIG. 11, a second packing member (140) is arranged between said lid (300) and stepped portion (120) of the upper body (100), thereby preventing ingress of water or foreign matter into manhole.

Furthermore, for installation of such a second packing member (140), a second groove (121) is formed on upper surface of the stepped portion (120), which groove becomes narrower from bottom to top, and on lower surface of said lid (300) is formed a first groove (310) into which is inserted and compressed an upper portion of the second packing member (140) fitted in the second groove (121).

That is to say, said second packing member (140) is formed in triangular shape of its cross section such that its lower end portion may be fitted in said second groove (121), and its upper end portion is fitted and compressed in said first groove (310), whereby waters or foreign matter are prevented from ingressing into between the upper body (100) and lid (300).

Furthermore, since the second groove (121) is formed in such a way to become narrower from bottom to top, the second packing member (140) is prevented from leaving the stepped portion (120) or playing and thus can be firmly secured.

In the case of sealing between the upper body (100) and lid (300) by means of the second packing member (140) arranged in such first groove (310) and second groove (121), it is preferable to arrange the packing member in construction of a different example from one example of the present invention. The reason is that the space for installation of the second packing member (140) is provided on the stepped portion (120) of the upper body (100).

Figure 12:
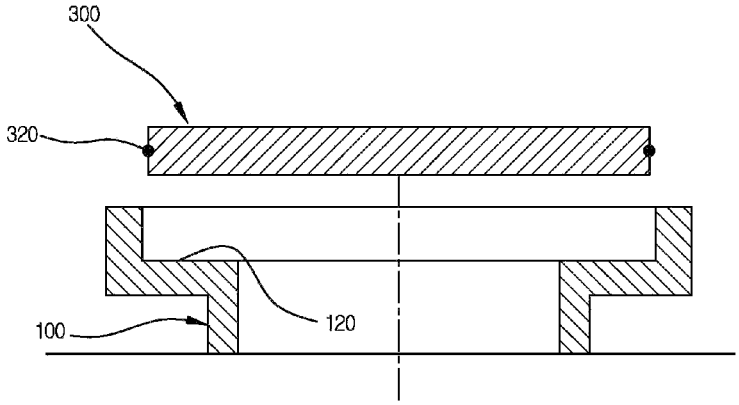
FIG. 12 is a sectional view illustrating a state of a third packing member of the present invention being arranged.

Meanwhile, as shown in FIG. 12, a third packing member (320) of O-ring shape is arranged on a side surface of the lid, thereby prevent the water or foreign matter from ingressing into a gap between the upper body (100) and lid (300). In addition, the arrangement of the third packing member (320) on the side surface of the lid is preferred in the case of securing the upper body (100) to the lower body (200) by use of the catching rod (170) as described above.

Since the catching rod (170) is installed on the stepped portion (120) of the upper body (100), a space for arranging the second packing member (140) may not be sufficient, and thus the third packing member (320) is arranged on the side surface of the lid (300).

Meanwhile, in the present invention, a gap may be generated between the upper body (100) and lower body (200) as the height of the upper body (100) is adjusted; a blocking ring (500) of synthetic resin material may be arranged in this gap to prevent ingress of earth or dust from the outside.

In the present invention as described above, in the case of lifting up the upper body (100) with the pitch (P) of the spiral ribs (110)(210) being sufficiently large, it is preferred that the upper body (100) is rotated and then laid down while the spiral ribs (110) of the upper body (100) and spiral ribs (210) of the lower body (200) do not contact with each other, and hence the upper body (100) can be upwardly or downwardly moved.

That is to say, it is preferred that the upper body can be rotated while no contact between the ribs occurs, with the pitch of the ribs being sufficiently large as opposed to conventional screwing.

The present invention is not limited to the specific preferred examples described above, it goes without saying that the persons having ordinary skills in the art may implement the present invention by various modification thereof without departing from the gist of the present invention defined by the claims, and such modification also falls within the scope of the claims.

The invention claimed is:

1. A manhole cover, comprising a lower body, the inside of which is hollow, with a spiral rib formed along the inner surface of the hollow space, and convex-concave portions formed on the upper surface of the spiral rib;

an upper body which is coupled with the lower body inside the latter, and the inside of which is hollow, with a spiral rib and convex-concave portions formed along outer surface of the upper body to correspond to the spiral rib and convex-concave portions of the lower body, and a stepped portion formed at the upper surface of the upper body;

a lid mounted on the stepped portion of the upper body to prevent the ingress of foreign matter into the inside of the upper body; and a waterproofing means removably arranged inside the upper body to prevent the ingress of rainwater into the inside of the manhole, wherein the waterproofing means comprises:

a waterproofing plate which is seated on a catching projection formed on the inner surface of the upper body to prevent ingress of rainwater;

a first packing member attached to edge of said waterproofing plate so as to wrap the edge, upper portion of the member being extended to upper end of the waterproofing plate and lower portion being in close contact with the catching projection so as to wrap the edge of the waterproofing plate; and a pressing ring arranged over said waterproofing plate and pressing the first packing member extended to the upper end of the waterproofing plate into close contact with the inner surface of the upper body, thereby achieving a tight waterproof.

2. The manhole cover according to claim 1, wherein said pressing ring is constructed in a turnbuckle type such that the diameter of the ring may be varied.

3. The manhole cover according to claim 1, wherein for said spiral ribs of the upper and lower bodies, two or more spiral ribs with the same pitch are formed at a constant interval such that coupling strength of the upper and lower bodies may be enhanced.

4. The manhole cover according to claim 1, wherein thread holes for fitting bolts are formed in the lower body, and the bolts are fastened through said thread holes to secure the upper body, thereby preventing lateral shaking of the upper body.

5. The manhole cover according to claim 1, further comprising a first groove which is formed along edge of lower surface of said lid;

a second groove which is formed on upper part of said stepped portion to correspond to said first groove and becomes narrower from bottom to top in its cross section; and a second packing member which is fitted and secured in said second groove and upper end portion of which is fitted in said first groove when the lid is mounted, thereby preventing foreign matter and rainwater from ingressing into the inside of the upper body.

6. A manhole cover, comprising a lower body, the inside of which is hollow, with a spiral rib formed along the inner surface of the hollow space, and a plurality of thread holes formed extending into the inside of the lower body;

an upper body which is coupled with the lower body inside the latter, and the inside of which is hollow, with a spiral rib formed along outer surface of the upper body to correspond to the spiral rib of the lower body, and a plurality of guide projections formed between the spiral ribs in a height direction of the upper body, and a stepped portion formed at the upper surface of the upper body;

bolts fitted through the thread holes of the lower body to press the upper body between the guide projections thereof, thereby supporting the upper body and at the same time preventing rotation of the upper body;

a lid mounted on the stepped portion of the upper body to prevent the ingress of foreign matter into the inside of the upper body; and a waterproofing means removably arranged inside the upper body to prevent the ingress of rainwater into the inside of the manhole, wherein the waterproofing means comprises a waterproofing plate which is seated on a catching projection formed on the inner surface of the upper body to prevent ingress of rainwater;

a first packing member attached to edge of said waterproofing plate so as to wrap the edge, upper portion of the member being extended to upper end of the waterproofing plate and lower portion being in close contact with the catching projection so as to wrap the edge of the waterproofing plate; and a pressing ring arranged over said waterproofing plate and pressing the first packing member extended to the upper end of the waterproofing plate into close contact with the inner surface of the upper body, thereby achieving a tight waterproof.

7. The manhole cover according to claim 6, wherein said thread holes are formed inclined downwardly toward the upper body, and said bolts are coupled through the inclined thread holes to push the upper surface of the spiral rib of the upper body in a downwardly inclined direction such that the upper body may be more stably supported.

8. The manhole cover according to claim 4, wherein said thread holes are formed inclined downwardly toward the upper body, and said bolts are coupled through the inclined thread holes to push the upper surface of the spiral rib of the upper body in a downwardly inclined direction such that the upper body may be more stably supported.

9. The manhole cover according to claim 6, wherein said pressing ring is constructed in a turnbuckle type such that the diameter of the ring may be varied.

10. The manhole cover according to claim 6, wherein for said spiral ribs of the upper and lower bodies, two or more spiral ribs with the same pitch are formed at a constant interval such that coupling strength of the upper and lower bodies may be enhanced.

11. The manhole cover according to claim 6, further comprising a first groove which is formed along edge of lower surface of said lid;

a second groove which is formed on upper part of said stepped portion to correspond to said first groove and becomes narrower from bottom to top in its cross section; and a second packing member which is fitted and secured in said second groove and upper end portion of which is fitted in said first groove when the lid is mounted, thereby preventing foreign matter and rainwater from ingressing into the inside of the upper body.

12. A manhole cover, comprising a lower body, the inside of which is hollow, with a spiral rib formed along the inner surface of the hollow space, and a plurality of catching grooves formed in a direction perpendicular to said spiral rib and at a constant interval;

an upper body with a spiral rib formed along outer surface of the upper body to correspond to the spiral rib of the lower body such that the upper body can be coupled with the lower body inside the latter, and a plurality of catching grooves formed in a direction perpendicular to said spiral rib of the upper body and at a constant interval, and a stepped portion formed at the upper portion of the upper body;

a plurality of catching rods which are installed between the upper body and lower body through the stepped portion and fitted in the catching grooves formed in the spiral ribs of the upper and lower bodies, thereby preventing the upper body from rotating inside the lower body;

a lid mounted on the stepped portion of the upper body to prevent foreign matter from ingressing into the inside of the upper body; and a waterproofing means removably arranged inside the upper body to prevent the ingress of rainwater into the inside of the manhole, wherein the waterproofing means comprises a waterproofing plate which is seated on a catching projection formed on the inner surface of the upper body to prevent ingress of rainwater:

a first packing member attached to edge of said waterproofing plate so as to wrap the edge, upper portion of the member being extended to upper end of the waterproofing plate and lower portion being in close contact with the catching projection so as to wrap the edge of the waterproofing plate; and a pressing ring arranged over said waterproofing plate and pressing the first packing member extended to the upper end of the waterproofing plate into close contact with the inner surface of the upper body, thereby achieving a tight waterproof.

13. The manhole cover according to claim 12, wherein said catching rods comprise a vertical rod part inserted through the stepped portion to be fitted in the catching grooves of said upper and lower bodies; and a horizontal rod part formed so as to be horizontally bent at an end portion of said vertical rod part and seated on the stepped portion.

14. The manhole cover according to claim 13, wherein formed in said stepped portion are rod-inserting holes for inserting said vertical rod part, and rod-seating grooves which are connected to said rod-inserting holes and in which said horizontal rod part is inserted.

15. The manhole cover according to claim 12, wherein said pressing ring is constructed in a turnbuckle type such that the diameter of the ring may be varied.

16. The manhole cover according to claim 12, wherein for said spiral ribs of the upper and lower bodies, two or more spiral ribs with the same pitch are formed at a constant interval such that coupling strength of the upper and lower bodies may be enhanced.

17. The manhole cover according to claim 12, further comprising a first groove which is formed along edge of lower surface of said lid;

a second groove which is formed on upper part of said stepped portion to correspond to said first groove and becomes narrower from bottom to top in its cross section; and a second packing member which is fitted and secured in said second groove and upper end portion of which is fitted in said first groove when the lid is mounted, thereby preventing foreign matter and rainwater from ingressing into the inside of the upper body.

* * * * *